United States Patent [19]
Ahuja et al.
[11] 4,317,685
[45] Mar. 2, 1982

[54] METHOD FOR REMOVING A SCALE FROM A SUPERALLOY SURFACE

[75] Inventors: Pritam L. Ahuja, West Chester, Ohio; Marcus P. Borom, Schenectady, N.Y.

[73] Assignee: General Electric Company, Cincinnati, Ohio

[21] Appl. No.: 157,610

[22] Filed: Jun. 6, 1980

[51] Int. Cl.[3] ..... B08B 3/10
[52] U.S. Cl. ..... 134/2; 134/21; 134/22.13; 134/27; 134/30
[58] Field of Search ..... 134/2, 3, 21, 22 R, 134/22 C, 27, 30

[56] References Cited

U.S. PATENT DOCUMENTS

| | | | |
|---|---|---|---|
| 2,796,366 | 6/1957 | Carter | 134/2 |
| 3,121,026 | 2/1964 | Beigay et al. | 134/2 |
| 3,126,301 | 3/1964 | Faler | 134/2 X |
| 4,073,662 | 2/1978 | Borom | 134/2 |
| 4,134,777 | 1/1979 | Borom | 134/2 |
| 4,188,237 | 2/1980 | Chasteen | 134/2 |

*Primary Examiner*—Marc L. Caroff
*Attorney, Agent, or Firm*—Lee H. Sachs; Derek P. Lawrence

[57] ABSTRACT

A method for removing scale, particularly oxide scale, from a surface of a high temperature alloy, the surface having been exposed to high temperature conditions, employs an aqueous alkaline hydroxide solution in contact with the scale in an autoclave. The solution is heated in the autoclave in a non-oxidizing atmosphere at a temperature in the range of about 200°–340° C. while providing relative movement between the solution and the scale. Thereafter, the scale reaction product is flushed from the surface to remove the alkaline solution.

2 Claims, No Drawings

METHOD FOR REMOVING A SCALE FROM A SUPERALLOY SURFACE

BACKGROUND OF THE INVENTION

1. Field of the Invention

This invention relates to removal of a scale from the surface of an article and, more particularly, to the removal of oxide from internal passages within an article.

2. Description of the Prior Art

As improved performance in modern gas turbine engines was achieved by increasing the temperatures experienced in the turbine section, it was found desirable by designers to change from solid components such as turbine blades to air cooled configurations. Generally included in the interior of such air cooled or hollow components is a serpentine cooling fluid path and a plurality of openings in interior walls as well as in exterior walls to provide for the passage and efflux of cooling fluid within and from the interior of such article. One typical fluid-cooled airfoil for use in high temperature conditions is shown in U.S. Pat. No. 3,628,885-Sidenstick et al patented Dec. 21, 1971 and assigned to the assignee of the present invention. The disclosure of such patent is incorporated herein by reference. As can be seen from the complexity of design, such a component is costly to manufacture.

Because such components as turbine airfoils are intended to operate under strenuous environmental conditions at elevated temperature, oxide, silicate and sulfide scales can collect on external surfaces as well as on internal passage surfaces. Such scales are particularly critical on internal surfaces because they can adversely affect the flow of cooling fluid, particularly through relatively narrow openings or passages in internal and external walls, and thus can adversely affect heat transfer characteristics of the component.

Repair processes for such costly fluid-cooled components as turbine blades and vanes have attempted to remove such scale from external surfaces through use of mechanical means such as grit blasting, abrasive rotating tools and ultrasonic vibration for external surfaces. Such mechanical methods are virtually ineffective on internal surfaces such as cooling passages. Acid leachants have been evaluated with the result that excessive attack on the metal of the component enlarged cooling passages, particularly fine openings, beyond acceptable limits and adversely affected the cooling characteristics of the component. In addition, fluoride vapor treatment for oxide removal can result in removal of some aluminum from the surface being treated.

SUMMARY OF THE INVENTION

A principal object of the present invention is to provide an improved method for removing oxide, silicate or sulfide scale or their combinations from surfaces, particularly those of an internal passage of an article without degrading aerodynamic or structural properties of the article, particularly the fluid flow characteristics of the passage.

Another object is to provide such a method which resists affecting internal coatings generally applied to such passages.

These and other objects and advantages will be more fully understood from the following detailed description of the preferred embodiments which are intended to be typical of, rather than in any way limiting on, the scope of the present invention.

Briefly, one form of the method associated with the present invention for removing oxide, silicate, sulfide or their combined reaction product or scale from a surface of an article, particularly from the surface of an internal passage or opening within an article which has been exposed to high temperature operating conditions comprises the steps of providing an aqueous solution of an alkaline hydroxide, preferably one selected from NaOH, KOH and their mixtures. The hydroxide comprises from about 20 weight percent to an amount which provides a saturated aqueous solution at a temperature of about 340° C. The scale on such surface is contacted, in the presence of a non-oxidizing atmosphere, with the aqueous solution in an autoclave in which it is heated at a temperature range of about 200°–340° C. for a time sufficient to react the solution with the scale to form a scale reaction product soluble in the solution. Relative movement between the solution and scale is provided to enable continuation of the reaction. Thereafter, such reaction product is flushed with the solution from the surface, such as the internal passage. Because retention of alkali in an internal passage can enhance hot corrosion of the article in subsequent high temperature operation, it is preferable to neutralize the alkaline hydroxide by flushing the passage with a dilute, neutralizing acid, although repeated water flushing can be used. The autoclave caustic method is particularly useful in a method for repairing a wall of an internal passage or opening in an article made of an alloy of the type used in gas turbine engines and based on at least one element selected from Fe, Co and Ni. If an internal coating is desired, it can then be applied after such scale removal.

DESCRIPTION OF THE PREFERRED EMBODIMENTS

Acid leaching as a means for cleaning or removing scale from internal passages in gas turbine engine hardware which has experienced operation can result in ineffective internal cleaning and excessive flow of cooling fluid due to enlargement of cooling holes or passages. The result has been rejection of otherwise serviceable articles. The method of the present invention provides a means for cleaning scale, particularly from internal passages and openings in components, coated or uncoated, without substantial effect on the substrate alloy or on any residual coating which may be deposited on such alloy.

Described in U.S. Pat. No. 4,073,662-Borom, patented Feb. 14, 1978, assigned to the assignee of the present invention and the disclosure of which is incorporated herein by reference, is a method for removing a ceramic core material from a casting formed about the core material. Described is the use of an aqueous hydroxide solution selected from NaOH and KOH in a heated autoclave for the leaching of the core. The present invention uses that same type of aqueous hydroxide solution heated in an autoclave. However, it has been recognized, unexpectedly, that specific criticalities exist in connection with the removal of a scale of an oxide or sulfide or silicate on their combinations from walls of an internal passage of an article in order to effectively remove such scale and, at the same time, avoid a relatively unstable pressure condition within the autoclave. For example, the present invention has recognized that the range of about 20–75 weight percent, and preferably 30–40 weight percent, of the hydroxide is required for practical removal of the scale. Below about 20 weight percent, the reaction is too sluggish, whereas about 75 weight percent represents virtually a saturated aqueous solution at the maximum operating temperature of about 340° C. That temperature is one at which the solution is approaching a critical regime or relationship between vapor and liquid. Greater than about 340° C. results in very rapid pressure increases with increasing temperature and, therefore, unstable, very high pressures in the autoclave vessel. Thus, the present invention has established the range of about 200°–340° C. in order to avoid such catastrophic increase in pressure. Evaluation of the present invention has shown that a significant increase in scale removal occurs when the temperature is maintained at least at about 230° C. Therefore, the preferred temperature for use in the present invention is 230°–330° C. In addition, because the scale removed rate doubles as the percentage of hydroxide increases from 20 to 40 weight percent, the range of 30–40 weight percent hydroxide is preferred. The time of exposure, generally about 2–10 hours, depends upon the type and thickness of the scale to be removed as well as the concentration of caustic and temperature of the bath.

The present invention is particularly useful in connection with the removal of oxide, sulfide, silicate or their combined reaction product or scale from the internal surfaces of high temperature superalloys used in gas turbine engines and generally based on one or more of the transition triad elements Fe, Co and Ni. In particular, Ni-base and Co-base superalloys are used as a material of construction in turbine blades and vanes of gas turbine engines. Therefore, the present invention was evaluated particularly in connection with the turbine blades from a commercially used aircraft gas turbine engine and made of a material sometimes referred to as Rene' 80 alloy. This alloy is described more particularly in U.S. Pat. No. 3,615,376-Ross, patented Oct. 26, 1971, the disclosure of which is incorporated herein by reference. After being exposed to operation in a gas turbine engine, it was observed that there was a two mil corrosion scale deposited on internal surfaces of a blade having a configuration similar to that of the above-described U.S. Pat. No. 3,628,885-Sidenstick et al.

EXAMPLE 1.

Such engine-run turbine blades were placed in an autoclave in which they were immersed in a solution of 40 weight percent NaOH with the balance essentially water. After sealing, the autoclave was flushed with argon gas and then heated at a temperature of about 305° C. (600° F.) for about 2 hours. The solution was agitated through the blades, although it should be understood that any relative movement between the blade interior and the solution would be adequate. After exposure in the autoclave, the turbine blades were removed and the solution, which at this point included the dissolved product resulting from reaction of the solution with the scale, was flushed from the internal surfaces using a dilute aqueous solution of either a mineral or organic acid, for example, about 2 vol. % HCl solution, and then water. The dilute acid flush is preferable to neutralize and aid in the removal of alkaline solution retained in internal passages, thus to avoid hot corrosion of the article in subsequent use. Subsequent inspection disclosed that the scale had been removed cleanly from the surface of internal portions of the blade with substantially no effect on the substrate alloy or the size of internal passages or openings.

An analysis identified $Al_2O_3$ and $Cr_2O_3$ to be the predominant component of that portion of the oxide scale which had been removed, according to the present invention, from internal surfaces of the article. Other less reactive and non-reactive oxides and sulfides, if present, were carried away with the dissolved product. This is possible due to encapsulation of such oxides within the $Al_2O_3$ and $Cr_2O_3$ scale. Therefore, practice of the method of the present invention for removing the scale resulting from exposure of superalloys to high temperature operating conditions is based on a careful balance of maintaining the aqueous hydroxide solution, preferably of NaOH or KOH, or their mixtures, in the range of 20–40 weight percent hydroxide with the balance of water, for use in an autoclave in a non-oxidizing atmosphere at a temperature in the range of about 200°–340° C. The non-oxidizing atmosphere, for example argon, is required and is an important feature of the present invention to avoid stress corrosion cracking of such engine-run components. Such cracking could result from the presence of residual stresses in the components and contact at autoclave temperatures with oxygen if an oxidizing atmosphere were present during scale removal.

EXAMPLE 2

In another evaluation, turbine blades of the above-described Rene' 80 nickel base superalloy were processed according to the method of the present invention described above in Example 1. These gas turbine engine blades had been exposed to operation under desert conditions and included heavy silicate deposits. In this example, the time of exposure was about 5 hours with the same successful results as in Example 1. After cleaning, the blades were aluminided in a pack process of the type described in U.S. Pat. No. 3,540,878-Levine et al, the disclosure of which is incorporated herein by reference.

The method of the present invention also has been found to be useful in removing the oxide scale, predominantly $Al_2O_3$, from the aluminide coated surface of articles such as the above-described Rene' 80 superalloy, as well as from the surface of cobalt base alloys such as a commercially available cobalt base superalloy sometimes referred to as X-40 alloy. Unlike acid leaching or fluoride vapor treatment, practice of the method of the present invention does not affect the residual, unoxidized aluminide coating on such surfaces. Acid leaching, which has been evaluated in some scale removal or cleaning type methods, tends to remove such residual, protective coatings. In addition, the acid can attack the substrate metal resulting in enlarged openings and damage to the article. Acid leaching is very difficult to control in such a method because of the depth of the reaction product formed and intergranular attack on the metal substrate.

The present invention has been described in connection with specific examples and embodiments. However, it will be understood by those skilled in the arts involved that the invention is capable of variations and modifications which are intended to be included within the scope of the appended claims.

What is claimed:

1. A method of removing scale from a surface of an internal passage within an article of a high temperature superalloy based on at least one element from the group consisting of Co and Ni, the scale being selected from the group consisting of oxides, silicates, sulfides and their combinations and being the corrosion products resulting from the surface having been exposed to strenuous environmental conditions at high temperature, comprising the steps of:

providing an aqueous alkaline hydroxide solution comprising about 20–75 weight percent of a hydroxide selected from the group consisting of NaOH, KOH and their mixtures;

immersing the surface in the hydroxide solution within a sealed autoclave in the presence of a non-oxidizing atmosphere;

heating the hydroxide solution in the autoclave at a temperature in the range from about 200 to a maximum of 340 C. for a time sufficient to react the solution with the scale to form a scale reaction product while providing relative movement between the solution and the scale within the internal passage; and then flushing the scale reaction product and the alkaline solution from the internal passage.

2. The method of claim 1 in which:

the hydroxide comprises about 30–40 weight percent of the aqueous solution; and the temperature in the autoclave is in the range of about 230°–330° C.

* * * * *